US007511236B2

(12) United States Patent
Mack

(10) Patent No.: US 7,511,236 B2
(45) Date of Patent: Mar. 31, 2009

(54) MANUAL CONTROL UNIT FOR A VEHICLE

(75) Inventor: Franz Mack, Kirchdorf/Iller (DE)

(73) Assignee: Kaessbohrer Gelaendefahrzeug AG, Laupheim (DE)

( * ) Notice: Subject to any disclaimer, the term of this patent is extended or adjusted under 35 U.S.C. 154(b) by 156 days.

(21) Appl. No.: 11/607,434

(22) Filed: Dec. 1, 2006

(65) Prior Publication Data

US 2008/0128253 A1 Jun. 5, 2008

(51) Int. Cl.
*H01H 9/30* (2006.01)

(52) U.S. Cl. ..... 200/61.54; 200/6 A; 74/471 XY

(58) Field of Classification Search ..... 200/61.54, 200/6 A, 6 R, 17 R, 18; 74/471 XY, 473.12, 74/473.33, 491; 180/272
See application file for complete search history.

(56) References Cited

U.S. PATENT DOCUMENTS 4,862,165 A * 8/1989 Gart ..... 341/20
5,566,586 A * 10/1996 Lauer et al. ..... 74/523
6,152,676 A * 11/2000 Evert et al. ..... 414/631
6,631,652 B1 10/2003 Okazawa et al.
6,948,398 B2 * 9/2005 Dybro ..... 74/471 XY

FOREIGN PATENT DOCUMENTS

EP 0 947 906 A2 10/1999
EP 0 965 901 A2 12/1999
WO WO 2004/010239 A1 1/2004

OTHER PUBLICATIONS

German Patent Office Office Action dated Apr. 5, 2007 (3 pages).

* cited by examiner

*Primary Examiner*—Kyung Lee
(74) *Attorney, Agent, or Firm*—Flynn, Thiel, Boutell & Tanis, P.C.

(57) ABSTRACT

A manual control unit having a handle body in which is integrated at least one manually operable control element.

Figure 1:
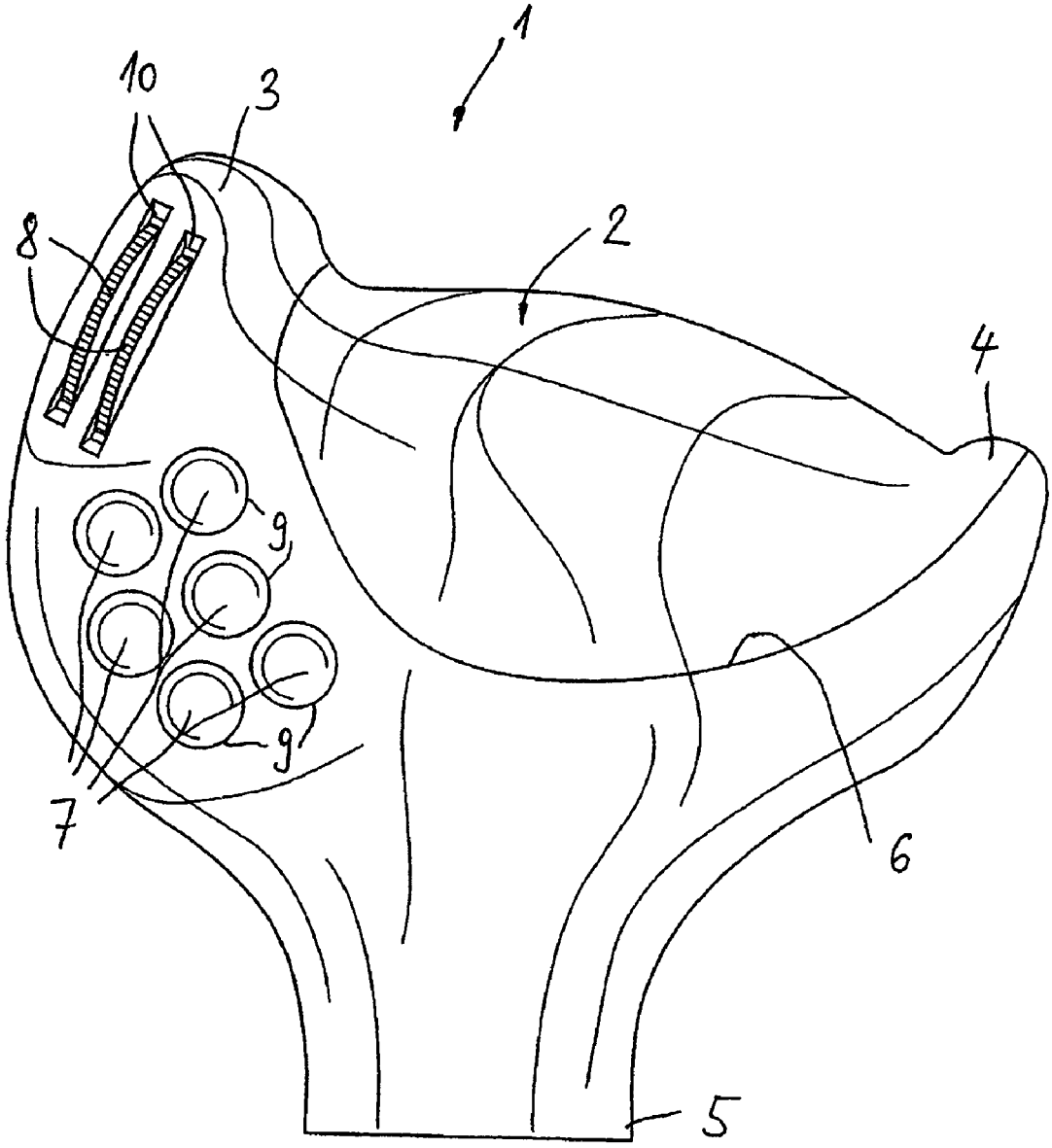

The handle body has a housing with a spherically bulged central section for ergonomically supporting an inner surface of a hand, the central section forming an upper apex surface of the handle body, and in that the at least one control element is arranged at a distance from the apex surface in such a way that, when the inner surface of a hand is being supported, the control element can be operated by one finger of the hand.

7 Claims, 5 Drawing Sheets

MANUAL CONTROL UNIT FOR A VEHICLE

The invention relates to a manual control unit for a vehicle having a handle body in which is integrated at least one manually operable control element.

In tracked vehicles for snow piste shaping and maintenance, it is known to provide a manual control unit in addition to a steering wheel at a driver's seating position in a driver's cab, said manual control unit, in the form of a "joystick", making it possible for a plurality of vehicle functions, such as the actuation of a clearing plate, a rear cutter or the like, to be controlled from the driver's seating position. A dashboard console, which is provided with operating switches for further vehicle functions, is also provided.

It is an object of the invention to provide a manual control unit of the type mentioned in the introduction with which it is possible for a plurality of vehicle functions to be operated in an ergonomically favorable fashion.

Said object is achieved in that the handle body has a housing with a spherically bulged central section for ergonomically supporting the inner surface of a hand, said central section forming an upper apex surface of the handle body, and in that the at least one control element is arranged at a distance from the apex surface in such a way that, when the inner surface of a hand is being supported, said control element can be operated by one finger of the hand. With the solution according to the invention, a driver of the vehicle can place his hand onto the handle body from above in a relaxed fashion and, with his hand in the supported hand position, can operate corresponding control elements with his fingers, said control elements being ergonomically positioned in such a way that they can be easily reached by the corresponding fingers of the hand without the operator having to lift his hand from the handle body. Operation can therefore be carried out without any expenditure of force. The solution according to the invention is suitable not only for use in vehicles for operating corresponding vehicle functions, but also for numerous other applications in which a plurality of functions are to be operable with one hand in an ergonomically favorable fashion. In the case of the manual control unit being used for a vehicle, further vehicle functions are preferably assigned to rotational or tilting movements of the overall handle body. Such rotational, pivoting or tilting movements of the handle body can bring about lifting or lowering movements or also tilting movements of functional parts of the vehicle, such as shovels, clearing plates, rear auxiliary devices, winches or the like.

One preferred use of the manual control unit is not only for snow piste vehicles but also for construction vehicles or for vehicles for agricultural, horticultural or forestry purposes. The manual control unit is also suitable for operating other machines and devices which are in no way related to vehicles, if it is advantageous in such a case for the control functions of a plurality of movement processes to be accommodated in an ergonomic fashion.

In one embodiment of the invention, the central section is flanked at opposite sides by in each case one lateral guide hump. The lateral guide humps serve to prevent the inner surface of the hand in the supporting position from slipping laterally from the spherically bulged central section. Here, the hand is supported in the central section such that, with the exception of the thumb, all the other fingers of the hand engage around the handle body to one side from above, whereas the thumb points past the corresponding lateral guide hump towards the other side.

In a further embodiment of the invention, a plurality of control elements are integrated into corresponding cut-outs of the handle body, which control elements are ergonomically arranged in such a way that they can be operated by corresponding fingers of the hand supported on the handle body in the hand position. The control elements are therefore positively assigned to the ergonomically most favorable position of the finger, so that no expenditure of force is required to operate the control elements with the corresponding fingers. The high degree of mobility of the thumb is utilized to accommodate a plurality of control elements in the region of motion of the thumb.

In a further embodiment of the invention, at least one control element is integrated in the region of that lateral guide hump which, when a hand is being supported, is adjacent to a thumb of the hand. A plurality of control elements are preferably grouped here, which control elements can be operated selectively by the thumb.

In a further embodiment of the invention, the handle body comprises two dimensionally stable housing shells which are detachably connected to one another. This makes it possible for the handle body to be produced economically in large numbers from thermoplastic synthetic material.

In a further embodiment of the invention, electric and/or electronic components, to which the control elements are attached, are accommodated in the housing. The electric and/or electronic components are suitably connected by means of electric or electronic lines to electric or electronic components of the vehicle.

In a further embodiment of the invention, the central section has a nonslip surface. The non-slip surface is preferably elastically resilient and can in particular be a coating or a suitable elastomer material protruding in said region, and serves to provide a comfortable and reliable support for the hand.

Further advantages and features of the invention can be gathered from the claims and from the following description of a preferred embodiment of the invention, which is illustrated in the drawings.

Figure 2:
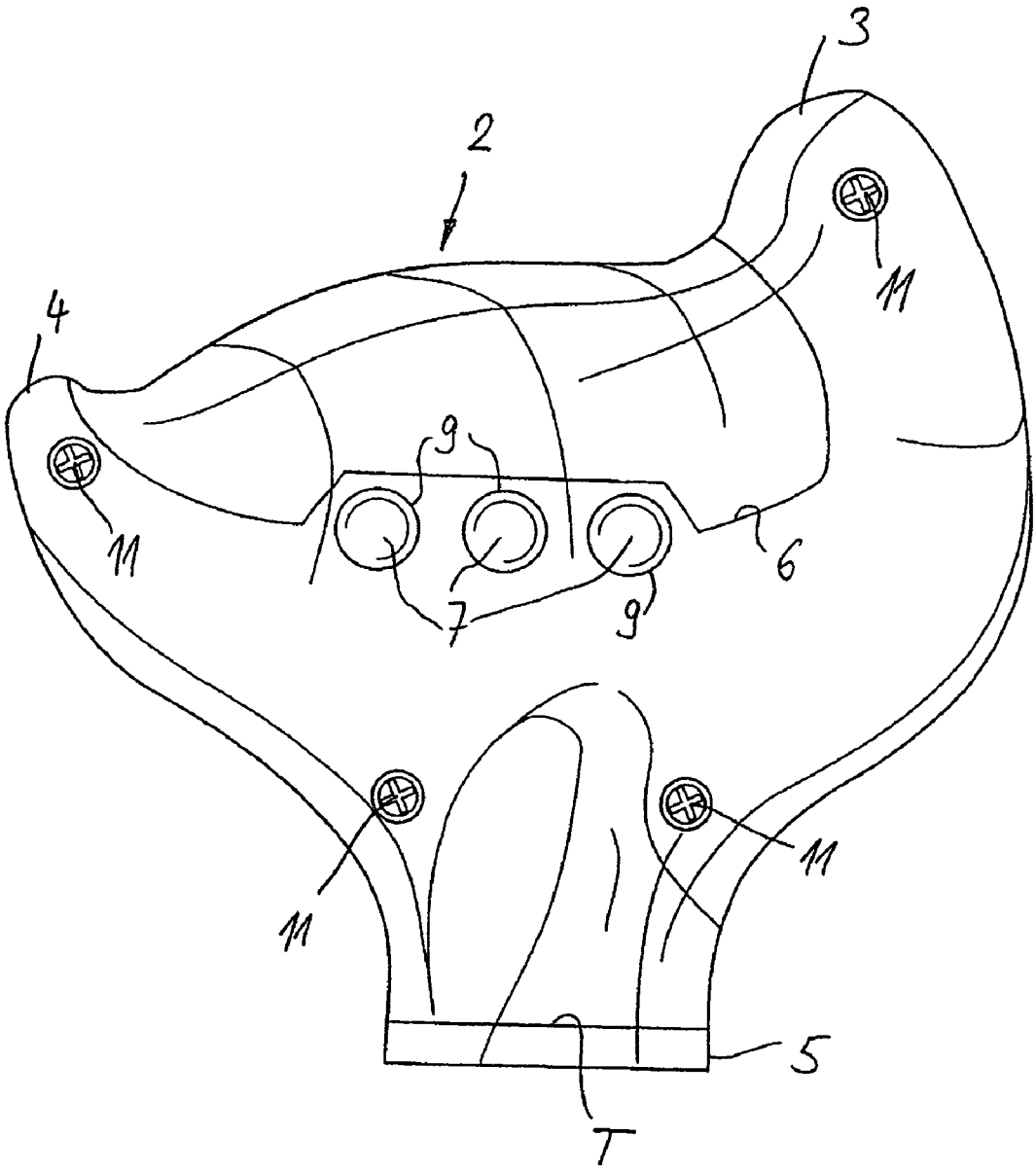
Figure 3:
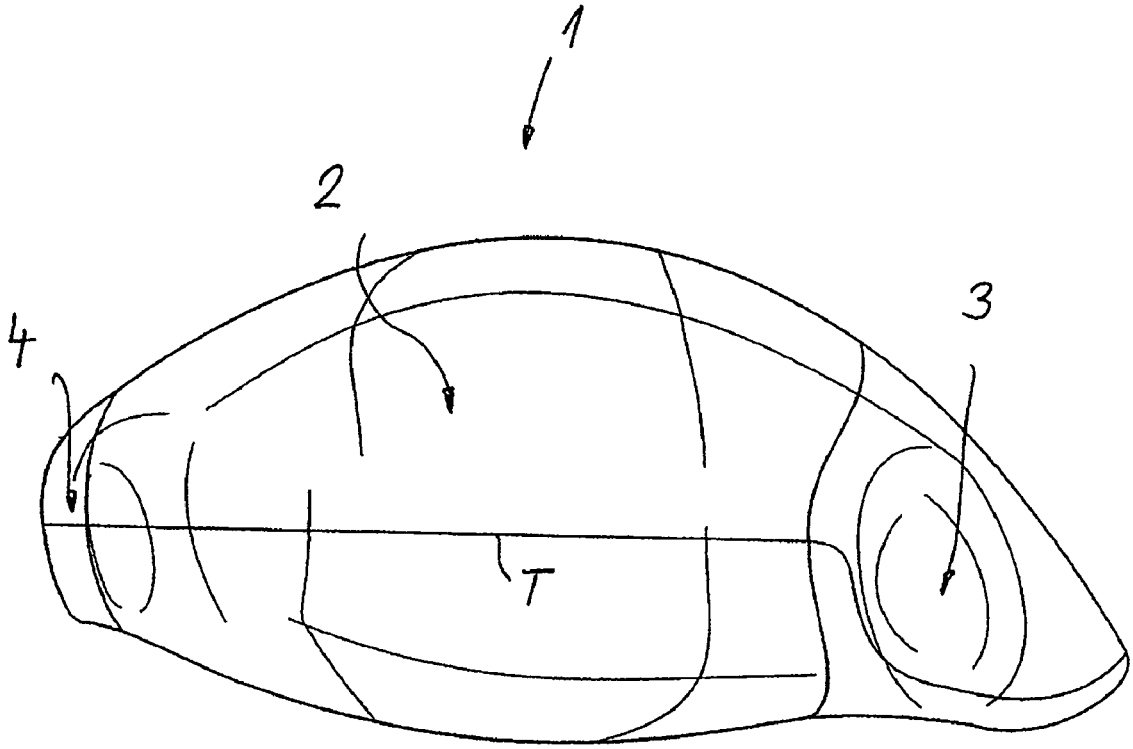
Figure 4:
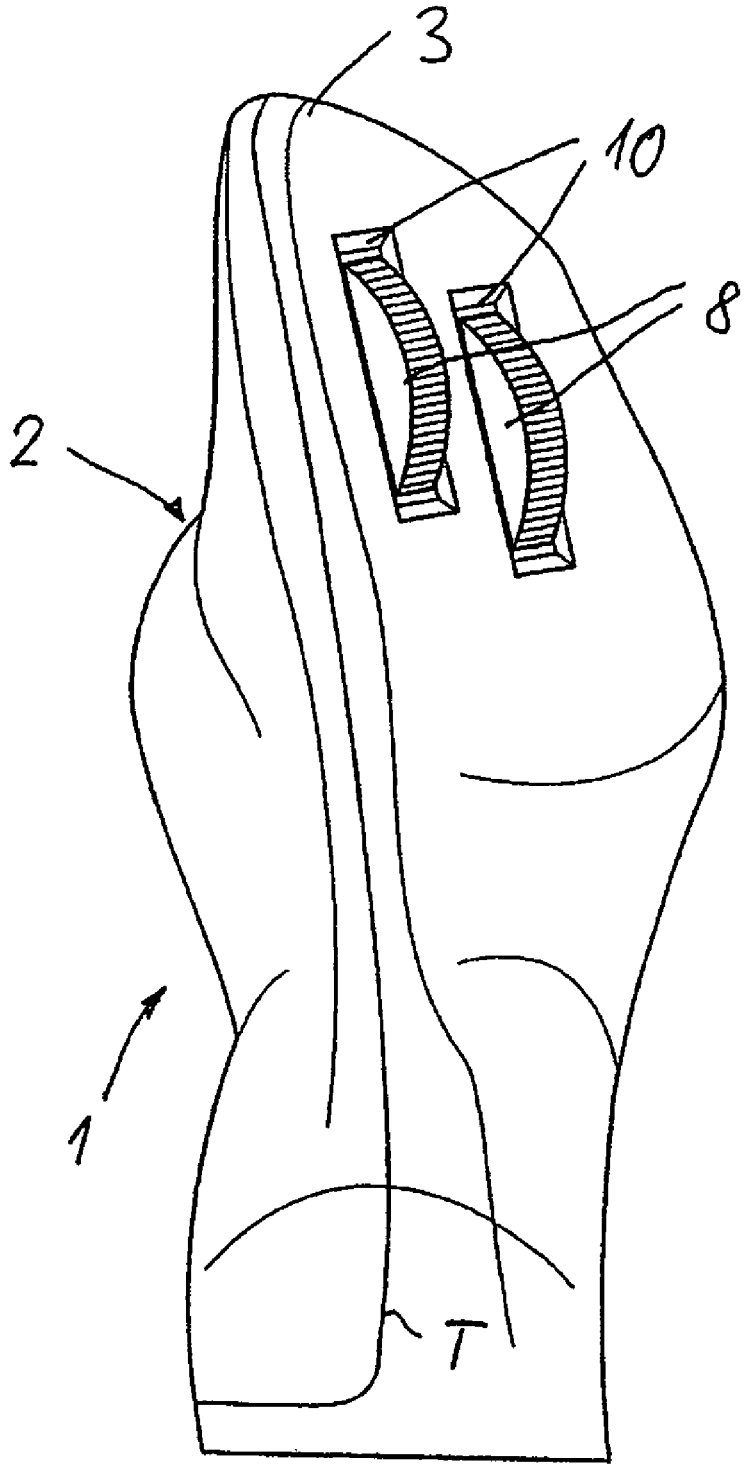
Figure 5:
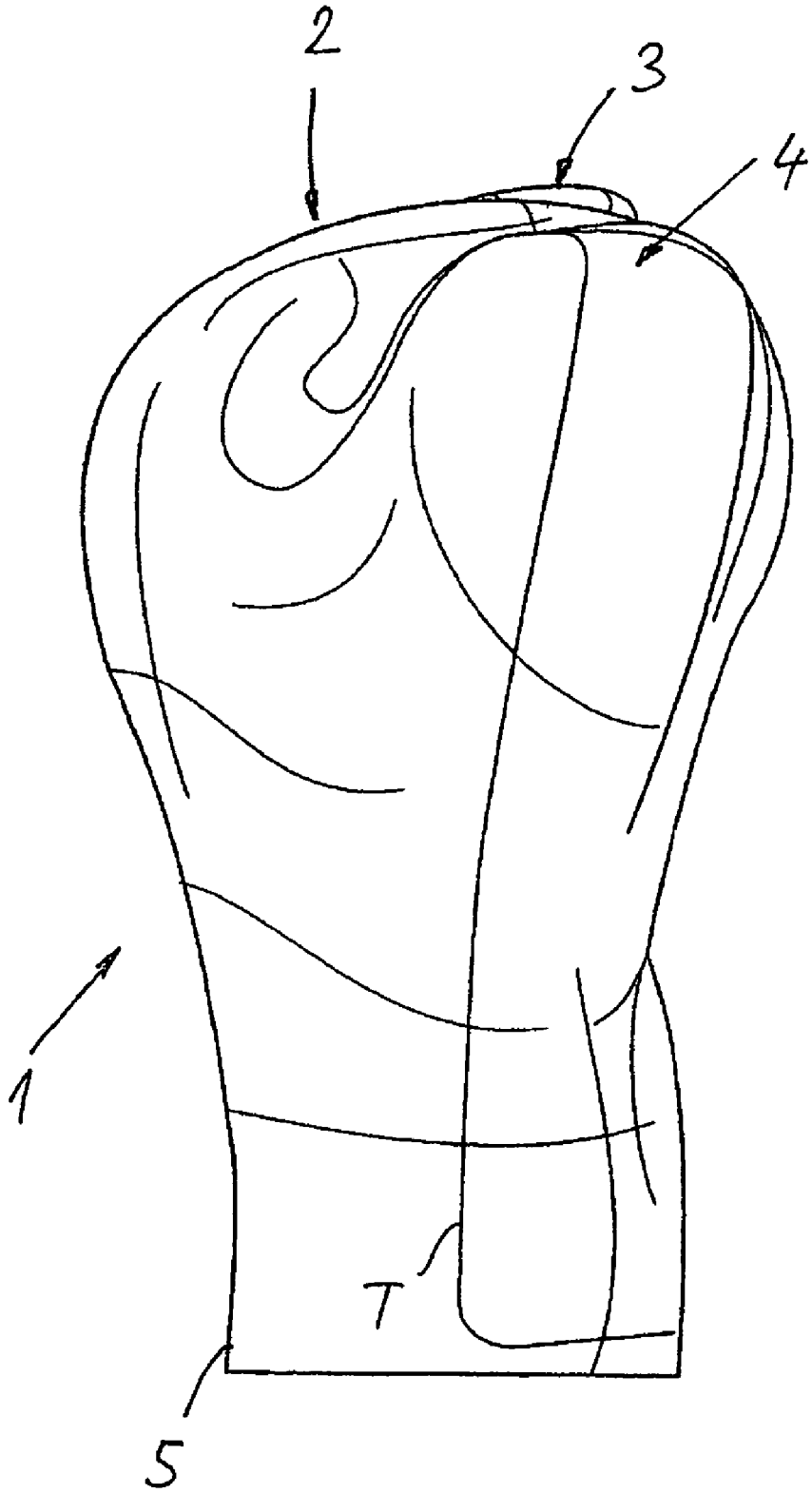

FIG. 1 shows, in a perspective illustration, an embodiment of a manual control unit according to the invention, FIG. 2 shows the manual control unit from FIG. 1, viewed from the opposite side, FIG. 3 shows the manual control unit from FIGS. 1 and 2, viewed from above, FIG. 4 shows the manual control unit from FIGS. 1 to 3 in a side view, and FIG. 5 shows the manual control unit from FIGS. 1 to 4 in a further side view from the opposite side to the side view in FIG. 4.

The manual control unit 1 in FIGS. 1 to 5 has a handle body which is shaped in the manner of the head of a cat. The handle body has a throat 5, by means of which it can be connected in a way which is not illustrated in any more detail, to an attachment part of an electromechanical, electric and/or electronic control unit of the vehicle. The handle body has a spherically bulged central section 2 which is designed in the shape of a head in such a way that the inner surface of a hand of an operator can be placed a really onto the central section 2 from above. The spherically bulged central section has approximately the dimensions of a tennis ball. As can be seen from FIG. 1, the central section 2 is provided over a large area with a coating surface which is delimited by the edge line 6. Said coating surface forms a non-slip surface and is formed in particular from an elastomeric material. The coating material is preferably formed to be large-pored such that it can absorb sweat.

The central section 2 is flanked at opposite sides by in each case one lateral guide hump 3, 4, which lateral guide humps 3, 4 are bulged upward in the manner of a dome. The lateral guide hump 3 is designed to be larger and higher than the opposite lateral guide hump 4. The two lateral guide humps 3, 4 serve to allow the hand of the operator to be securely centered, positioned and aligned on the central section 2. The larger lateral guide hump 3 flanks the edge of the hand formed by the index finger, and the smaller lateral guide hump 4 flanks the edge of the hand formed by the small finger. In an operating position, the inner surface of the hand of the operator is placed on the spherically bulged central section from above, with the four fingers of the hand excluding the thumb extending to the front side of the handle body illustrated in FIG. 2. The thumb projects to the opposite side, so that the larger lateral guide hump 3 extends upward between the thumb and the index finger. The rear side of the handle body, which can be operated by the thumb, is illustrated in FIG. 1.

The handle body is formed by a housing which is composed of two housing shells which are connected to one another along a parting line T to form the handle body. The two housing shells are detachably connected to one another in the region of a plurality of fastening points, here by means of four fastening screws 11 (FIG. 2). The throat region 5 is formed entirely by one of the two housing shells, and forms a closed ring in the lower edge region of the handle body, as can be seen in FIGS. 2, 4 and 5.

The housing of the handle body has a plurality of cut-outs 9, 10, into which are integrated control elements 7, 8 which are in contact with electric and/or electronic components within the housing. For example, six control buttons 7 which actuate electric switches in the interior of the housing are provided in the rear side which can be operated by the thumb. Two slot-shaped cut-outs 10 are provided at the side of the housing, close below a dome of the lateral guide hump 3, with adjusting wheels 8 of corresponding potentiometers protruding out through said slot-shaped cut-outs 10. The adjusting wheels 8 are provided with knurlings in the region of their periphery, and can likewise be operated by the thumb of the hand of the corresponding operator. The adjusting wheels 8 and the control buttons 7 which can be operated by the thumb are visible to the operator, so that a corresponding control element can be actuated in a targeted fashion by eye and thumb. Three actuating buttons 7 are arranged adjacent to one another in the region of the front side, which faces away from the operator, of the handle body (FIG. 2), with said actuating buttons 7, like the control buttons 7, actuating corresponding switches in the interior of the housing. The three actuating buttons 7 are arranged such that they can be actuated in an ergonomically comfortable fashion with the index finger, middle finger and ring finger of the hand supported on the central section 2. In this way, the corresponding actuating button can be actuated "blind", that is to say without the operator seeing the actuating buttons.

The invention claimed is:

1. A manual control unit comprising a handle body having at least one manually operable control element integrated therewith, the handle body comprising a housing having a spherically bulged central section for ergonomically supporting an inner surface of a hand provided between two lateral guide humps which protrude upwardly from an upper surface of the handle body for preventing the inner surface of the hand from slipping laterally from the central section, the central section forming an upper apex surface of the handle body and the at least one manually operable control element being positioned on the housing such that when the inner surface of the hand is supported on the upper apex surface of the handle body, the at least one control element can be operated by one finger of the hand.

2. The manual control unit of claim 1, wherein the handle body comprises two dimensionally stable housing shells which are detachably connected to one another.

3. The manual control unit of claim 1, wherein electric and/or electronic components, to which the control elements are attached, are accommodated in the housing.

4. The manual control unit of claim 1, wherein the central section has a non-slip surface.

5. The manual control unit of claim 1, wherein a plurality of manually operable control elements are integrated in corresponding cut-outs provided in the handle body and are ergonomically positioned such that they can be operated by corresponding fingers of the hand supported on the upper apex surface of the handle body.

6. The manual control unit of claim 1, wherein the at least manually operable control element is integrated in the region of the lateral guide hump which is adjacent to a thumb of the hand when the hand is supported on the upper apex surface of the handle body.

7. The manual control unit of claim 1, wherein at least one manually operable control element is provided at a first side of the housing and is adapted to engage with a thumb of the hand supported on the upper apex surface of the handle body and at least one manually operable control element is provided at a second side of the housing opposite to the first side and is adapted to engage with at least one finger of the hand supported on the upper apex surface of the handle body.

* * * * *